US005630648A

United States Patent [19]

Allard et al.

[11] Patent Number: 5,630,648

[45] Date of Patent: May 20, 1997

[54] DYNAMIC POSTURE CHAIR

[75] Inventors: Peter B. Allard, Minnetonka; Jack K. Hockenberry, Albert Lea, both of Minn.; Harry C. Sweere, 5637 Woodlawn Blvd., Minneapolis, Minn. 55417

[73] Assignees: Harry C. Sweere; Industrial Design Center Inc., both of Minneapolis, Minn.

[21] Appl. No.: 372,854

[22] Filed: Jan. 13, 1995

Related U.S. Application Data

[63] Continuation of Ser. No. 936,576, Aug. 27, 1992, abandoned.

[51] Int. Cl.[6] ..... A47C 1/027; A47C 1/032

[52] U.S. Cl. ..... 297/327; 297/313; 297/302.1

[58] Field of Search ..... 297/326, 327, 297/340, 344, 345, 458, 459, 460, 325, 313, 302.1, 344.15, 344.1, 338, 374, 316; 248/188.8, 188.9, 371; 16/40, 44, 45

[56] References Cited

U.S. PATENT DOCUMENTS

| | | | |
|---|---|---|---|
| 114,532 | 5/1871 | Cozzens | 297/303 |
| 667,869 | 2/1901 | Davidson | 297/411 |
| 1,065,022 | 6/1913 | Bell | 297/195 |
| 1,887,647 | 11/1932 | Kochs et al. | 297/327 |
| 2,100,170 | 11/1937 | Parks | 297/326 |
| 2,970,638 | 2/1961 | Halter | 297/460 |
| 3,043,624 | 7/1962 | Mason | 297/303 |
| 3,181,828 | 5/1965 | Cramer | 297/423 |
| 3,349,425 | 10/1967 | Rabelos | 16/44 |
| 3,376,070 | 4/1968 | Johnson | 297/458 |
| 4,131,260 | 12/1978 | Ambasz | 248/384 |
| 4,306,750 | 12/1981 | Wenger et al. | 297/458 |
| 4,453,687 | 6/1984 | Sweere | 248/183 |
| 4,465,266 | 8/1984 | Hale | 297/345 |
| 4,478,454 | 10/1984 | Faiks | 297/316 |
| 4,526,422 | 7/1985 | Mengshoel et al. | 297/423 |
| 4,552,404 | 11/1985 | Congleton | 297/330 |
| 4,589,699 | 5/1986 | Dungan | 297/423 |
| 4,607,882 | 8/1986 | Opsvik | 297/458 |
| 4,636,004 | 1/1987 | Neumuller | 297/374 |
| 4,690,459 | 9/1987 | Ullman | 297/423 |
| 4,693,514 | 9/1987 | Volkle | 297/374 |
| 4,738,487 | 4/1988 | Shalinsky et al. | 297/313 |
| 4,790,595 | 12/1988 | Hensel et al. | 297/285 |
| 4,818,019 | 4/1989 | Mrotz III | 297/303 |
| 4,836,478 | 6/1989 | Sweere | 248/124 |
| 4,889,387 | 12/1989 | Gregory | 297/458 |
| 4,915,449 | 4/1990 | Piretti | 297/326 |
| 4,921,304 | 5/1990 | Kjersem | 297/458 |
| 5,042,876 | 8/1991 | Faiks | 297/304 |
| 5,186,519 | 2/1993 | Larson | 297/423 |

FOREIGN PATENT DOCUMENTS

| | | | |
|---|---|---|---|
| 1429288 | 2/1969 | Germany | 297/326 |
| 1581523 | 12/1980 | United Kingdom | 16/44 |

*Primary Examiner*—Amy B. Vanatta

*Attorney, Agent, or Firm*—Merchant, Gould, Smith, Edell, Welter & Schmidt, P.A.

[57] ABSTRACT

A dynamic posture chair is disclosed which is capable of use in a range of sit/stand positions. The chair includes a mobile base that is selectively movable by the user and the chair member that is mounted to the base with a tilt mechanism that enables the chair member to be selectively and infinitely tilted over a predetermined of tilt positions while resistively restraining the chair member in the selected tilt position. The chair member includes seat and back members that relatively subtend an angle in the range of about 120 degrees to 135 degrees. The chair member has a uniquely shaped fixed seat/back contour that instantly supports in comfort the back, buttocks and thighs of the user in its lowest and highest vertical positions, and in all positions in between. The tilt mechanism prevents the chair member to be pivotally tilted over an angular range of not greater than about 30 degrees, enabling the user to fully sit on the chair in the rearward most tilt position, and to rest his/her feet at least partially on the floor in the forward most tilt position.

27 Claims, 4 Drawing Sheets

DYNAMIC POSTURE CHAIR

This is a continuation of application Ser. No. 07/936,576, filed on Aug. 27, 1992, now abandoned.

BACKGROUND OF THE INVENTION

The invention broadly relates to seated body support and is specifically directed to chair devices in which a chair member may be tilted or otherwise moved relative to a chair support.

One of the most difficult problems in chair design is achieving long term comfort, whether task or audience seating is involved. It has been found that maintaining substantially equal pressure distribution throughout the surface area of the body that is in contact with the chair results in the greater comfort, but the human body often becomes uncomfortable, tired and fatigued if the same posture in the chair is maintained over a long period of time. It is now well established that to sustain long term comfort, a dynamic posture function is necessary; i.e., one which permits the chair member to be tilted or otherwise moved by the user relative to its support or base.

There are many types of chairs that provide a dynamic posture function, but virtually all such chairs encounter practical or economic problems. From the economic standpoint, enabling the chair member to move relative to its base necessarily involves some type of pivot mechanism that increases chair cost. This generally means that the dynamic posture function cannot be incorporated into lower cost chairs, such as stacking chairs sold to office product markets and audience seating markets.

Where mechanical movement has been included as a chair function, the mechanism generally is spring loaded and constantly seeks to return the chair to its upright position. This feature imposes added pressure on the body surface contact with the chair unless the chair can be locked in position. While a mechanical feature may be incorporated that enables the user to periodically move the chair into a desired tilt angle, this not only increases the cost of the chair but also requires periodic manual adjustment by the user.

We have found that this problem can be practically and economically solved with a tilt mechanism that permits an infinitely variable tilt over a predetermined range of movement as the result of normal body movement, and which remains in the position chosen by the user. The tilt mechanism has a built-in resistance which is frictional in the preferred embodiment, and operates on a substantially inertia free basis. The user may simply move his or her body forward or rearward, and the chair member follows in a smooth and flowing manner that is analogous to high viscosity fluid motion. When the desired position is reached, the user simply ceases his/her body movement, and the chair is thereafter retained in the desired position.

The tilt mechanism is relatively inexpensive, and both economically and efficiently provides a dynamic posture function to maintain substantially equal pressure distribution and body comfort over relatively long periods of time.

The broad invention of incorporating the unique tilt mechanism to accomplish the dynamic posture function finds application in a broad range of seating applications, and in particular in a sit/stand chair usable by persons who normally must remain on their feet during a particular job or task. An example is a grocery checkout clerk, who generally stands in a single, confined area. The grocery checkout task can be quite intense for the checkout clerk, involving long periods of standing (e.g., 4–8 hours) with relatively severe body strain.

An attempt has been made to solve the problem of discomfort by incorporating lean stands at the checkout counter, but such devices cannot provide a continuous body support function without the user experiencing discomfort. In particular, lean stands cannot distribute upper weight evenly over that part of the body that contacts the stand, resulting in point pressure that leads to discomfort. Further, a lean stand obviously cannot provide a dynamic posture function, requiring the clerk to move periodically to a more comfortable position.

The inventive chair which is disclosed solves these problems through the combination of a friction controlled tilt mechanism, a unique chair member and a selectively movable mobile base. The chair member has seat and back members that are relatively disposed at an open angle that is much larger than a conventional chair, and the seat member is uniquely configured for a straddle type support. With the chair in its forward tilt position, the user has substantial contact with both the seat and back members, but his/her feet may remain on the floor in a balanced position. As such, the chair is in essence leaned on by the user, but full body support is offered.

The user may also tilt the chair rearwardly over a range of positions through the use of the friction controlled mechanical pivot mechanism, and progressively greater support is transferred from the user's feet to the chair member. Whatever the desired tilt position, the unique chair provides support to the user's buttocks, thigh/pelvic area and lower back, and distributes weight in a manner which greater enhances the user's comfort.

The pivot mechanism uniquely incorporates friction disk brake elements formed from ultra high molecular weight polyethylene (UHMWP). Unlike most substances, UHMWP has static and dynamic coefficients of friction that are almost identical. The utilization of this material between interfacing elements of dissimilar materials (e.g., plated steel or anodized aluminum) results in a frictional interface that is substantially linear (similar to a hydraulic pump) as pressure is applied by the user to tilt the chair member. The chair member thus moves from one desired tilt position to another with little effort on the part of the user, and it is retained in any desired tilt position without any effort on the part of the user.

The chair member itself has been uniquely designed and sized to accommodate the vast majority of potential users. The publication *Basic Design Measurements for Sitting* by Clara A. Ritter, published by the University of Arkansas in 1959, includes seated body size contour data that facilitates the design of conventional chairs to accommodate body sizes from the 5th percentile female to the 95th percentile male. This data has been uniquely translated to the open angled sit/stand chair to likewise accommodate this broad percentile range.

The mobile base for the chair is designed to be maintained in an immobile position when it is in use, but it otherwise can be easily moved to a different floor location. In the preferred embodiment, this is accomplished through the use of a large pedestal base the diameter of which is sufficient to resist tipping throughout the range of tasks. The pedestal base is supported at three points by cylindrical rollers that are mounted in a fixed position and in relative opposition to one another. As such, the sit/stand chair will not easily roll to another position, although a simple lifting of the chair member at a single point will place primary support on a single roller, enabling the chair to be easily moved.

In an alternative embodiment, the chair base includes a relatively large circular housing and three spring loaded casters that are normally urged downward in contact with the floor or support surface. When the chair is not in use, the casters lift the chair and circular housing from the floor, and the chair can be easily moved. As soon as the user places any degree of weight on the chair the casters are automatically retracted, permitting the circular housing to contact the floor to prevent movement.

The various and inventive structure and functions of the chair will be more fully appreciated from the drawings and following technical description.

DETAILED DESCRIPTION OF THE PREFERRED EMBODIMENT

Figure 1:
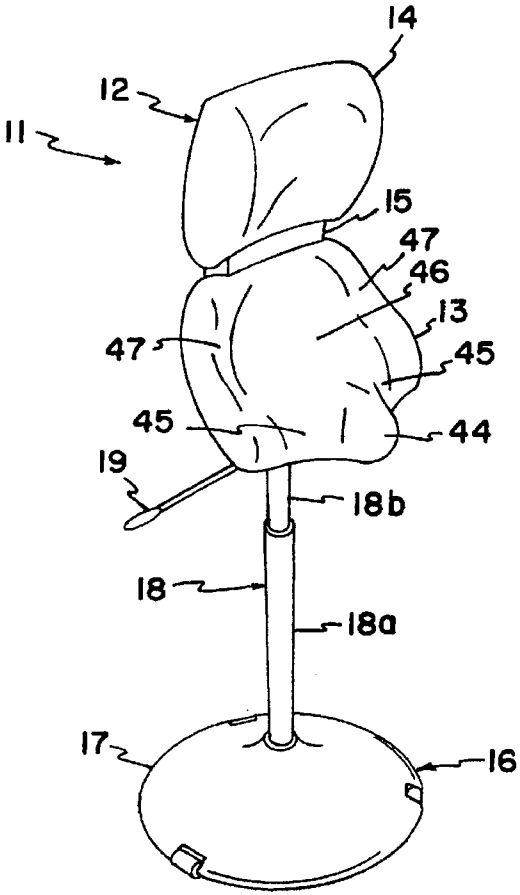
FIG. 1 is a perspective view of an ergonomic tiltable chair intended for use in sit/stand tasks.
Figure 2:
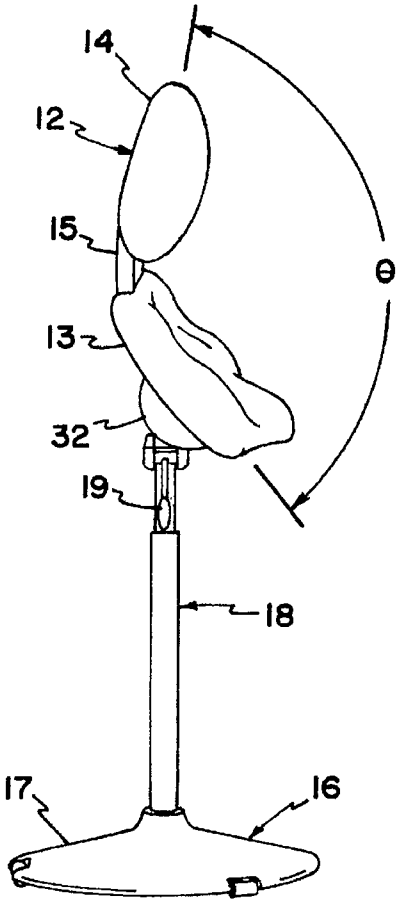
FIG. 2 is a side elevation of the tiltable chair in a forward tilt position.
Figure 3:
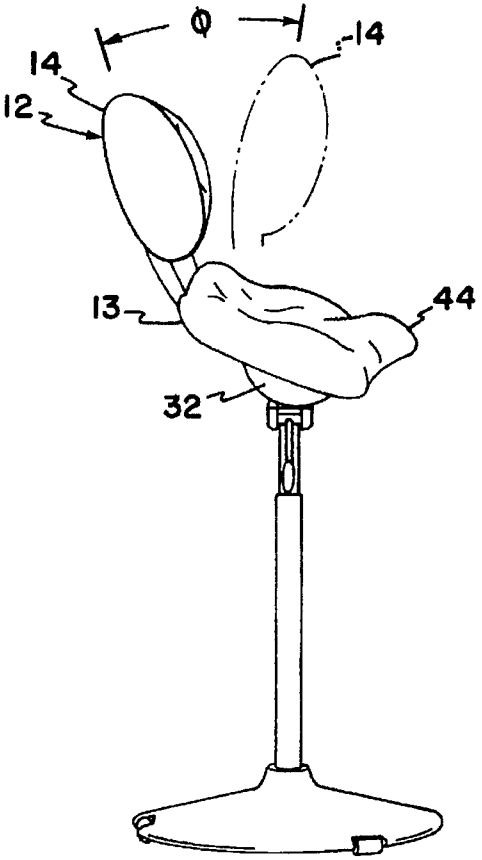
FIG. 3 is a view of the tiltable chair similar to FIG. 2 with the chair in a rearward tilt position.

With initial reference to FIGS. 1–3, an ergonomic tiltable chair intended for use in sit/stand tasks is represented generally by the numeral 11. Chair 11 broadly comprises a chair member 12 formed from a seat member 13 and a back member 14. In the preferred embodiment, seat 13 and back 14 are connected in a fixed relative position by a connecting member 15. With specific reference to FIG. 2, seat 13 and back 14 are relatively disposed at an angle θ, which may range from about 120 degrees to 135 degrees. In the preferred embodiment, the angle is approximately 130 degrees.

With continued reference to FIGS. 1–3, chair 11 further comprises a chair base or support bearing the general reference numeral 16. Chair base 16 specifically comprises a mobile pedestal base 17 from which a single pedestal support member 18 vertically projects. In the preferred embodiment, support member 18 comprises a conventional telescoping gas cylinder that permits vertical adjustment of the chair member 12 relative to the chair base 16. It specifically comprises a sealed cylinder **18*a* having a predetermined volume of a compressible gas and a rod or shaft 18*b* the lower end of which acts as a piston to compress the gas and cylinder 18*a*. A handle member 19 may be used to actuate a locking mechanism that locks the members 18*a*, 18*b* in a fixed relative portion (not shown). Typically, the handle 19 is spring loaded to a normal locking position, permitting the user to lift the handle when an adjustment to the chair member 12 is desired, and release of the handle 19** automatically locks the device in the selected position.

Figure 4:
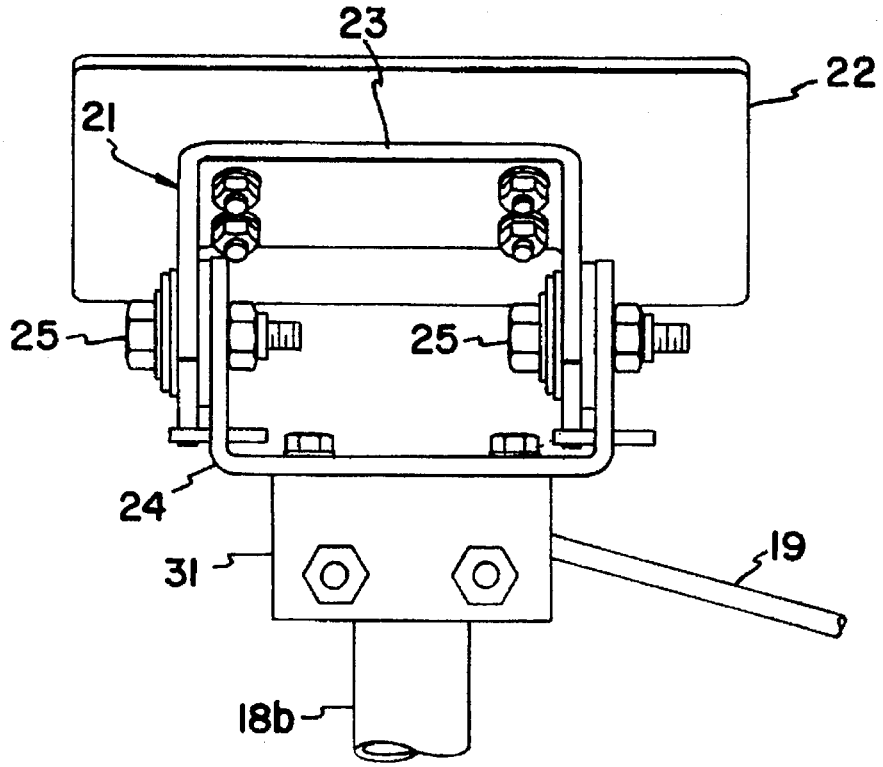
FIG. 4 is an enlarged fragmentary view in rear elevation of the tilt mechanism.

With reference to FIGS. 2–5, chair member 12 is connected to the shaft **18*b* of vertical support member 18 by a low inertia, frictional tilt mechanism bearing the general reference numeral 21. The seat member 13, which is not shown in FIG. 4, is mounted to a rectangular base plate 22. Base plate 22 is in turn mounted to an upper bracket member 23 of the tilt mechanism 21. Upper bracket 23 is U-shaped, with its connecting portion formed at an oblique angle to permit base plate 22 and seat member 13 to be mounted at a predetermined angle of inclination. The opposed legs of bracket member 23 project downward and are received in a staggered or offset relation by the upwardly projecting legs of a lower bracket member 24**.

Figure 5:
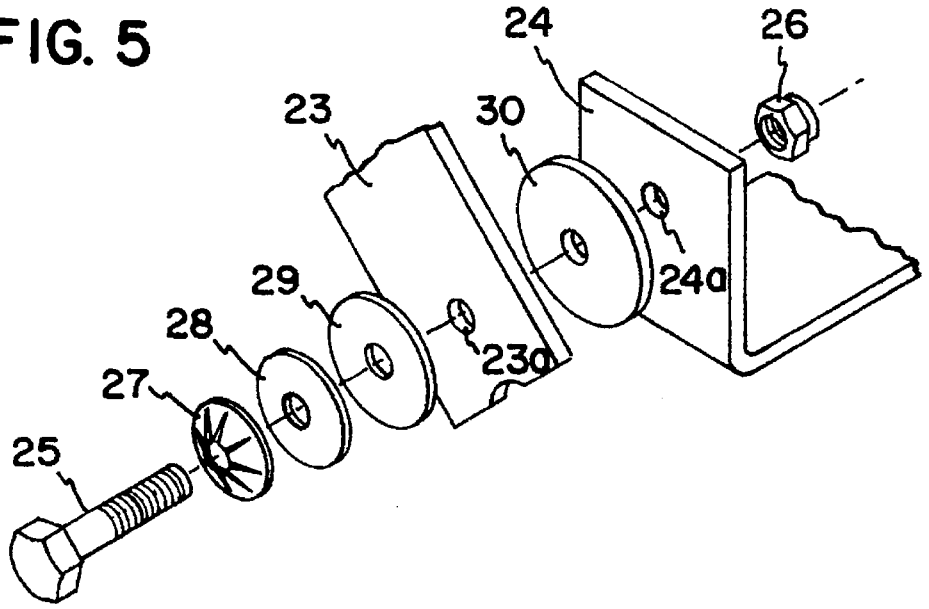
FIG. 5 is a further enlarged fragmentary exploded perspective view of portions of the tilt mechanism.

The respective legs of the upper and lower bracket members 23, 24 are frictionally interconnected as shown in FIG. 5. Bores **23*a*, 24*a* are formed in the opposed legs of bracket members 23, 24, respectively, and a bolt 25 passes through the registered bores and is held in place by a lock nut 26. Disposed between the head of bolt 25 and the outer face of bracket leg 23 are a conical spring washer 27, a conventional steel washer 28 and an oilite thrust washer 29. A friction disk 30 formed from a material such as ultra high molecular weight polyethylene (UHMWP) is disposed between the opposed faces of bracket legs 23, 24**.

The static and dynamic coefficients of friction of UHMWP are almost identical, and the frictional interface between the disk 30 and the associated faces of bracket legs 23, 24 is substantially linear as pressure is applied by the user to tilt the chair member. As noted above, it takes very little effort on the part of the user to move the chair member 12 from one tilt position to another, and because the tilt mechanism 21 automatically retains the chair member 12 in a desired position, no effort is required on the part of the user to keep the chair member 12 in the desired tilt position.

It will be noted in FIG. 4 that, based on the staggered relationship of bracket members 23, 24, the connecting components 25–30 are aligned in the same direction, which produces greater uniformity in the low inertia friction function of the mechanism 21.

Lower bracket member 24 is secured to a mounting bracket 31 fastened to the upper end of shaft **18*b*, and which also houses handle 19**.

With reference to FIGS. 2 and 3, a semicircular housing 32 (which is not shown in FIG. 4) is placed over the tilt mechanism 21 for aesthetic purposes.

As constructed, the tilt mechanism 21 provides a dynamic posture feature, enabling the chair member 12 to be tilted in a manner that is substantially inertia free. In other words, the user can selectively position the chair member 12 in a desired tilt position, and based on the frictional resistance of the mechanism 21, chair member 12 will remain in the desired position with no pressure or force exerted by the mechanism itself. Dynamic posture shifting occurs automatically when the user moves his or her upper body forward or rearward to the desired task posture, but unlike conventional mechanisms, the tilt mechanism 21 does not offer or generate any return force. The resulting sensation to the user is a slow, smoothly flowing, high viscosity fluid motion. When the desired tilt position is reached, the user simply stops upper body movement and the chair position is retained by the mechanism 21.

With reference to FIG. 3, chair member 12 can be tilted through an angular range Φ which, in the preferred embodiment, is no greater than about 30 degrees.

Figure 6:
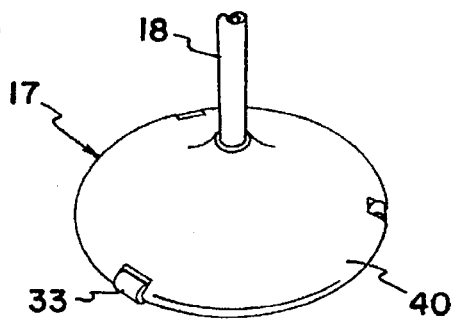
FIG. 6 is a fragmentary perspective view of the mobile base for the chair.
Figure 7:
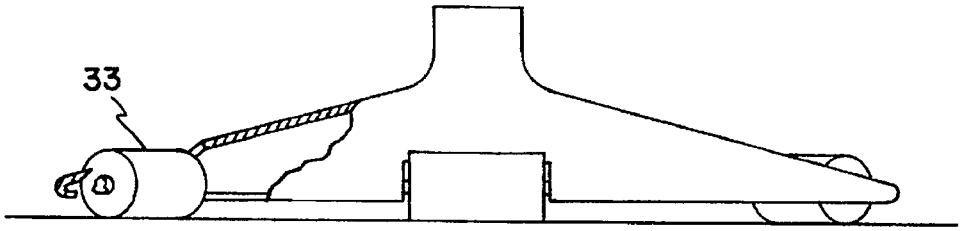
FIG. 7 is an enlarged view and side elevation of the mobile base, portions thereof shown in section.

With reference to FIGS. 6 and 7, the mobile base 17 consists of a shallow conical housing 40 that is preferably circular in configuration, and which includes three equi-angularly spaced cylindrical rollers 33 mounted at its periphery. A three point support for mobile base 17 is preferred because it provides excellent stability for the chair 11 over the range of tilt positions of the chair member 12 and the sit/stand position of the user. To provide optimum stability, mobile base 17 should have a minimum diameter of approximately 17 inches, which will avoid the likelihood of tipping chair 11 over if inadvertently bumped.

It will be observed that each of the cylindrical rollers 33 is mounted on a horizontal axis of rotation that is substantially perpendicular to a radius of the circular base 17. As such, each of the rollers 33 rolls in a direction that is in substantial opposition to the other two, which restricts mobility of the chair 11 during normal operation. If the user wishes to move the chair 11, it need only be slightly tipped on the roller of the desired direction, and it thereafter moves easily.

Figure 8:
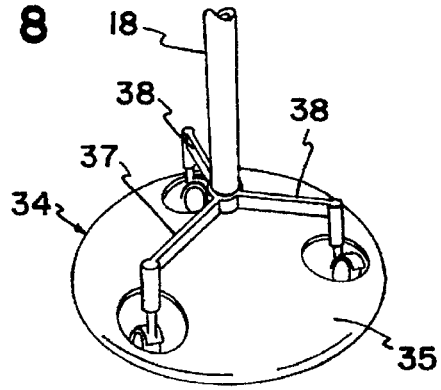
FIG. 8 is a perspective view of an alternative embodiment of the mobile base.
Figure 9:
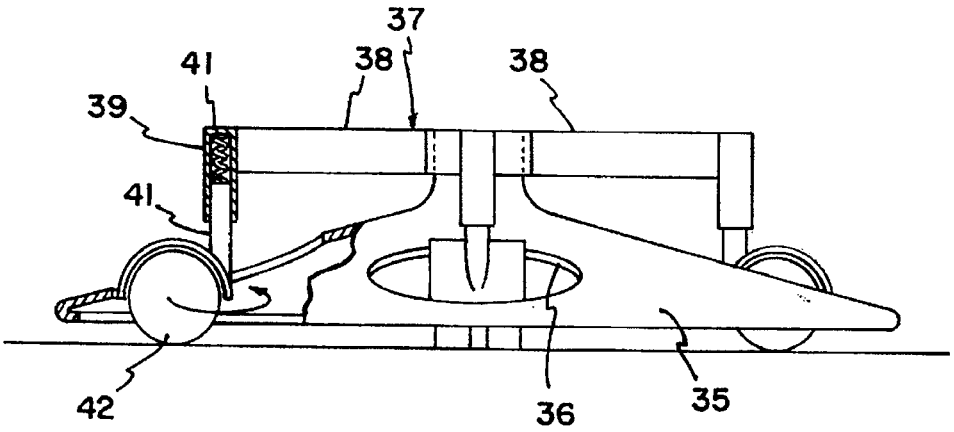
FIG. 9 is an enlarged and side elevation of the mobile base of FIG. 8, portions thereof being shown in section.

FIGS. 8 and 9 depict an alternative embodiment of the mobile base which bears reference numeral 34. Base 34 comprises a shallow, generally conical housing 35 similar to that of base 17 with three large, equi-angularly spaced apertures 36 formed approximate its peripheral edge. Housing 35 is carried at the bottom end of cylinder 18, as is a concentrically disposed spider support 37. Spider support 37 includes three radially extending support arms 38 each of which carries a vertically disposed cylindrical socket member 39 at its outer end. Each of the socket members 39 houses a compression spring 41. A wheeled caster 42 is provided for each of the sockets 39, each caster 41 having an upwardly projecting stub shaft 43 that is received within the socket 39 and bears against spring 41. Springs 41 are chosen relative to the weight of the chair 11 such that, when a user is not seated on the chair member 12, and the entire chair is lifted to the position shown in FIG. 9 with casters 42 engaging the floor. As such, chair 11 may be easily moved by the user to any desired position. When the user sits or leans on chair 11, the user's weight is greater than the force generated by springs 41, and the casters 42 recede into the housing 35. While casters 42 remain in contact with the floor, the lower circular edge of the housing 35 becomes the load bearing line for chair 11, which can no longer be moved.

Figure 11:
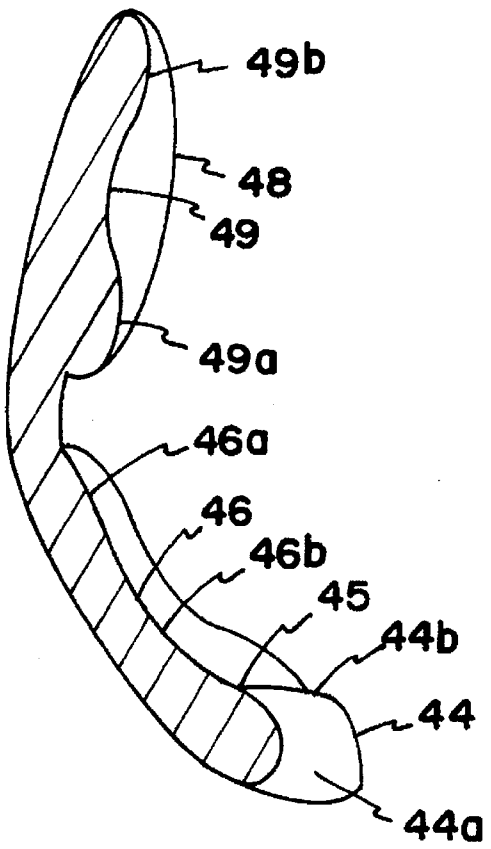
FIG. 11 is a sectional view taken along line 11—11 of FIG. 10.

With reference to FIGS. 1–3 and 10–11, the specific configuration of the chair member 12 significantly facilitates use of the sit/stand chair 11 and ensures comfort to the user throughout the range of sit/stand positions. The configuration of seat member 13 is of particular uniqueness and importance because the user does not sit in a conventional manner. To this end, chair member 13 includes a pelvic ridge member 44 that is centrally disposed along the lower or forward edge of the chair member 13. As best shown in FIGS. 3 and 11, pelvic ridge member 44 projects both upwardly and forwardly from the forward edge of chair member 13. The upward projection or rise is curved to comfortably support the user's torso while at the same time preventing it from sliding forward and downward when the tilt mechanism 21 is in its most forward position. The pelvic ridge member 44 thus supports the user's pelvic region, and at the same time spreads the user's legs in a straddling position for optimum balance.

Figure 10:
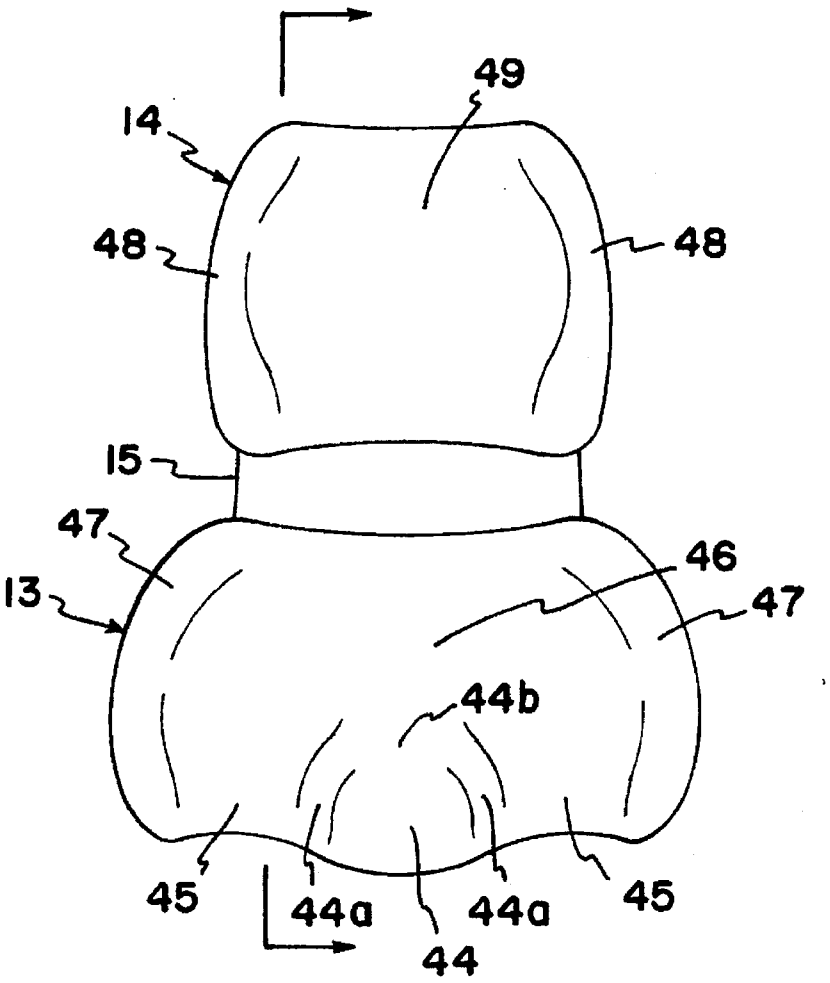
FIG. 10 is a front elevational view of the seat and back of the chair.

With specific reference to FIG. 10, pelvic ridge member 44 has sides **44*a* that curve laterally and smoothly merge with adjacent thigh support regions 45, each of which is a shallow concave at the forward edge of chair member 13 to comfortably accommodate the underside of the user's thighs. Although generally concave, it will also be noted in FIG. 11 that the extreme forward edge of chair member 13 at the thigh support regions 45 rises slightly, which also resists the user from sliding forward and off the chair member 13** when it is in the forward tilt position.

It has been noted above that pelvic ridge member 44 projects forwardly to be straddled by the user, and as particularly shown in FIGS. 1 and 10, the member 44 curves laterally and rearwardly to merge with the leading edge of each of the thigh support regions 45.

As best shown in FIGS. 3, 10 and 11, the center line of pelvic ridge member 44 curves downwardly and rearwardly into a buttock support region 46, which is a concave depression bounded on each side by raised sides 47 of the chair member 13. As shown in FIG. 10, sides 47 extend from the rear to the front of chair member 13 and also serve to define the outer lateral boundary of thigh support regions 45. As best shown in FIG. 1, the chair member sides 47 smoothly curve into both the associated thigh support regions 45 as well as the buttock support region 46.

With reference to FIG. 11, the buttock support region 46 rises rearwardly toward the rear edge of chair member 13, as represented at **46*a***, which causes the user's pelvis to pivot forward, thus moving the user's spine into a sacro-lumbar curve, which will enhance comfort and decrease fatigue.

The human pelvis has downwardly projecting prominences, known as ischial tuberosities, which are load bearing points of the torso in a sitting position. The point at which the ischial tuberosities are supported within the buttock support region bears reference numeral **46*a*. The distance between this point and the forward or leading edge of the thigh support regions 45** is much less than a conventional chair because of the sit/stand dynamic posture feature. A distance of approximately six inches has been found to provide the proper support, while enabling the user's legs to be comfortably moved throughout a range of sit/stand positions.

As constructed, the chair member 13 serves to relieve point pressure as the user sits or stands against the chair 11, spreading such pressure into the thigh support regions 45 and buttock support region 46. To facilitate this function, the chair member 13 is preferably padded or cushioned.

With reference to FIGS. 1–3 and 10–11 in particular, back member 14 has side ridges 48 that respectively curve into a central concave region 49. As best shown in FIG. 11, the lower portion of central concave region 49 rises from this concavity in the downward direction, which defines a lumbar support region **49*a*. There is a similar rise in the upward direction from central region 49 as shown in 49*b***.

As described hereinabove, the angle between seat and back members 13, 14 is much greater for chair member 12 because of the sit/stand function than the corresponding angle would be in a conventional chair. Further, to accommodate the greatest numbers of users for the chair 11, the seated body size contour data from the University of Arkansas study identified above has been uniquely translated into sit/stand contour data. As a result, the chair member 12 will accommodate adult sizes in standing posture from the 5th percentile female through the 95th percentile male.

Chair 11 is particularly useful for users who must customarily stand in a single area over long periods of time, such as grocery checkout clerks. For such individuals, chair 11 easily and comfortably provides a dynamic function; i.e., it tilts over an entire range of sit/stand positions at the choice of the user. This is facilitated by the tilt mechanism 21, which enables the user to instantaneously select a desired tilt position simply through rearward or forward body movement, and the chair member 12 is retained in the selected position until the user desires a different position.

In operation, the user initially positions the chair member 12 at an appropriate height through use of the handle 19. With the chair member 12 in the forward tilt position as shown in FIGS. 1 and 2, the user may straddle pelvic ridge member 44 in an essentially standing position, receiving support from both the seat and back members 13, 14. Chair 11 will not tip because of the size of mobile base 17 and the fact that the rollers 33 are in opposition. In this position, the user's feet touch the floor but are spread by the pelvic ridge member 44 for optimum balance. To maintain a proper balance, the chair member 12 must be positioned over the tilt mechanism 21 so that the vertical support member 18 is generally on a line extending through the center of the user's body.

Should the user wish to change positions, he/she need only begin a rearward body movement, which overcomes the friction of tilt mechanism 21 and causes chair member 12 to smoothly tilt to the desired position. When the desired position is reached, the user simply stops rearward body movement and the chair member 12 is retained in that position by the tilt mechanism 21. Forward tilting movement is accomplished in the same manner by forward body movement.

When the user is in the position of greatest rearward tilt as shown in FIG. 3, his/her feet may be lifted from the floor, and the chair member 12 provides complete support of the user's body and equal weight distribution over the seat and back members 13, 14.

Over the entire range of tilt positions, as well as the full range of vertical adjustment, the chair 11 distributes upper body weight throughout the feet, thigh/pelvic region, buttocks and back areas, thus enhancing the user's comfort and at the same time significantly reducing fatigue.

What is claimed is:

1. A dynamic posture chair intended for use in sit/stand tasks, comprising:

a chair member comprising a seat member and a back member that are integrally connected and relatively subtend an angle in the range of about 120°–135°;

support means for the chair member, the support means being adapted to be supported by a support surface;

tiltable mounting means for tiltably mounting the chair member to the chair member support means, the tiltable mounting means being constructed and arranged to enable the chair member to be selectively and infinitely tilted over a predetermined range of tilt positions comprising:

a first friction surface disposed on the chair member;

a second friction surface disposed on the support means in substantial opposition to the first friction surface;

a friction brake member disposed between said first and second friction surfaces and having opposed side surfaces that respectively engage said first and second friction surfaces in frictional relation, the friction brake member being formed from a material having coefficients of static and dynamic friction that are substantially equal; and means for pivotally securing the friction brake member to the first and second friction surfaces in face-to-face relation to permit said tilting movement between the chair member and support means;

the tiltable mounting means being constructed and arranged so that the tilting of the chair member to various desired tilt positions within said predetermined range can be effected solely by forward and rearward leaning movement of a user in the chair member, with said tiltable mounting means permitting tilting movement to be initiated by the user with said leaning movement and resistably restraining the chair member in the desired tilt position when said leaning movement ceases.

2. The chair defined by claim 1, which comprises means associated with the chair member support means for vertically adjusting the height of the chair member relative to the chair member support means.

3. The chair defined by claim 2, wherein the vertical adjusting means comprises cylinder means having first and second members that move relatively in telescoping relation, and means for selectively locking said first and second members in a fixed relative position.

4. The chair defined by claim 1, which further comprises means associated with the chair member support means for enabling selective mobility thereof relative to the support surface.

5. The chair defined by claim 4, wherein the chair member support means comprises a base housing member of predetermined size and having a predetermined center, and the selective mobility means comprises:

a plurality of roller members that are relatively angularly spaced with respect to said center; and means for mounting each of the roller members to the base housing member for rolling movement about a fixed axis that is substantially perpendicular to a line passing through said center.

6. The chair defined by claim 5, wherein the base housing member is circular, and the selective mobility means comprises three equi-angularly spaced rollers.

7. The chair defined by claim 6, wherein each of said rollers is cylindrical in configuration.

8. The chair defined by claim 4, wherein the chair member support means comprising a base housing member of predetermined size having a predetermined center and defining a floor engaging surface, and the selective mobility means comprises:

a plurality of caster members that are selectively angularly spaced with respect to said center; and means for mounting each of the caster members to the base housing member for vertical movement relative thereto, said mounting means comprising spring means for normally biasing the casting member to project below the floor engaging surface, the caster members and spring means being constructed and arranged so that the caster members recede vertically during use of the chair to permit the chair to rest on said floor engaging surface.

9. The chair defined by claim 8, wherein the base housing member is circular, and the selective mobility means comprises three equi-angularly spaced caster members.

10. The chair defined by claim 1, wherein the tiltable mounting means comprises upper and lower members respectively mounted to the chair member support means, the first and second friction surfaces being respectively disposed on the upper and lower members, and means for mounting the upper and lower members for relative pivotal movement about a substantially horizontal axis.

11. The chair defined by claim 10, wherein the upper and lower members each comprises a U-shaped member, the upper member having downwardly projecting legs that overlap upwardly projecting legs of the lower member.

12. The chair defined by claim 11, wherein the overlapping legs of said upper and lower members are formed with registering bores to define said substantially horizontal axis, and said friction brake member is disposed between said respective legs and means for clamping said friction disk member into frictional relation therewith.

13. The chair defined by claim 12, wherein said clamping means comprises a spring washer mounted on bolt means passing through said legs and said disk.

14. A dynamic posture chair intended for use in sit/stand tasks, comprising:

a chair member comprising a seat member having forward and rearward edges and a back member having upper and lower edges, the seat and back members being integrally connected and subtending an angle in the range of about 120°–135°, the seat member comprising:

a pelvic ridge member centrally disposed proximate the front edge of the chair member and projecting upwardly and forwardly thereof;

first and second generally concave thigh support regions disposed laterally of the pelvic ridge member on opposite sides thereof; and a concave buttock support region disposed rearwardly of the pelvic ridge member and thigh support regions;

support means for the chair member, the support means being adapted to be supported by a support surface; and tiltable mounting means for tiltably mounting the chair member to the chair member support means to permit pivotal tilting of the chair member over a predetermined range of tilt positions comprising:

a first friction surface disposed on the chair member;

a second friction surface disposed on the support means in substantial opposition to the first friction surface;

a friction brake member disposed between said first and second friction surfaces and having opposed side surfaces that respectively engage said first and second friction surfaces in frictional relation, the friction brake member being formed from a material having coefficients of static and dynamic friction that are substantially equal; and means for pivotally securing the friction brake member to the first and second friction surfaces in face-to-face relation to permit said tilting movement between the chair member and support means;

the tiltable mounting means constructed and arranged so that tilting of the chair member to various desired tilt positions within said range of angles can be effected solely by forward and rearward leaning movement of a user in the chair member, with said tiltable mounting means permitting tilting movement to be initiated by the user with said leaning movement and resistably restraining the chair member in the desired tilt position when said leaning movement ceases.

15. The chair defined by claim 14, in which the chair member further comprises first and second side ridge members respectively extending along the opposite sides of the chair member, each ridge member being disposed laterally adjacent the buttock support region and associated one of said thigh support regions.

16. The chair defined by claim 15, wherein the juncture of said pelvic ridge member into said thigh support regions and said buttock support region is smoothly contoured.

17. The chair defined by claim 16, wherein the juncture of each of said side ridge members with said buttock support region and the associated thigh support region is smoothly contoured.

18. The chair defined by claim 14, wherein the buttock support region is raised proximate the rearward edge of the chair member.

19. The chair defined by claim 14, wherein each of said thigh support regions is raised at the front edge of the chair member.

20. The chair defined by claim 14, wherein the buttock support region defines a lateral line along which the ischial tuberosities of a human pelvis are normally supported, and the distance from said line to the front edge of the chair member at said thigh support regions is approximately six inches.

21. The chair defined by claim 14, wherein the back member comprises a central concave region that rises toward the lower edge of the back member to define a lumbar support region.

22. The chair defined by claim 21, wherein the central concave region rises toward the upper edge of the back member.

23. The chair defined by claim 22, which further comprises first and second side ridge members that define the central concave region in part.

24. The chair defined by claim 23, wherein the chair and back members are formed from cushioned material.

25. A tilt friction control mechanism for use in a chair comprising a chair member and a chair base to permit user controlled tilting between the chair member and chair base, the tilt friction control mechanism comprising:

a first member adapted for connection to one of said chair member and chair base and defining a first predetermined friction surface;

a second member adapted for connection to the other of said chair member and chair base and defining a second predetermined friction surface disposed in substantial opposition to said first friction surface;

a friction brake member disposed between said first and second members and having opposed side surfaces that respectively engage the first and second friction surfaces in frictional relation, said friction brake member being formed from a material having coefficients of static and dynamic friction that are substantially equal; and means for securing said first and second members and said friction brake member in face-to-face relation for pivotal movement about a predetermined axis that extends transversely therethrough, said securing means being constructed and arranged to clamp said members to cause a frictional interface therebetween;

said first and second members, friction brake member and securing means being cooperably constructed and arranged so that tilting of the chair member to various desired tilt positions can be effected solely by forward and rearward leaning movement of the user in the chair member, and further constructed and arranged to permit tilting movement to be initiated by the user with said leaning movement and to resistably restrain the chair member in the desired tilt position when said leaning movement ceases.

26. The tilt friction control mechanism defined by claim 25, wherein said friction brake member is formed from ultra high molecular weight polyethylene.

27. A dynamic posture chair comprising:

a chair member;

support means for the chair member, the support means being adapted to be supported by a support surface;

tiltable mounting means for tiltably mounting the chair member to the chair member support means, the tiltable mounting means being constructed and arranged to enable the chair member to be selectively and infinitely tilted over a predetermined range of tilt positions comprising:

a first friction surface disposed on the chair member;

a second friction surface disposed on the support means in substantial opposition to the first friction surface;

a friction brake member disposed between said first and second friction surfaces and having opposed side surfaces that respectively engage said first and second friction surfaces in frictional relation, the friction brake member being formed from a material having coefficients of static and dynamic friction that are substantially equal; and means for pivotally securing the friction brake member to the first and second friction surfaces in face-to-face relation to permit said tilting movement between the chair member and support means;

the tiltable mounting means being constructed and arranged so that tilting of the chair member to various desired tilt positions within said predetermined range can be effected solely by forward and rearward leaning movement of a user in the chair member, with said tiltable mounting means permitting tilting movement to be initiated by the user with said leaning moment and resistably restraining the chair member in the desired tilt position when said leaning movement ceases.

* * * * *